US005135113A

United States Patent [19]

Mayer et al.

[11] Patent Number: 5,135,113

[45] Date of Patent: Aug. 4, 1992

[54] HIGH-SPEED TABLET SORTING MACHINE

[75] Inventors: Daniel W. Mayer, St. Paul; Steven W. Broders, Little Canada, both of Minn.

[73] Assignee: Modern Controls, Inc., Minneapolis, Minn.

[21] Appl. No.: 678,117

[22] Filed: Apr. 1, 1991

[51] Int. Cl.[5] ..... B07C 5/02; B07C 5/28

[52] U.S. Cl. ..... 209/539; 209/571; 209/657; 209/915; 209/931; 324/663; 324/673

[58] Field of Search ..... 209/539, 552, 571, 592, 209/596, 656, 657, 915, 919, 931; 177/210 C; 324/658, 661, 662, 663, 671-673, 679, 680, 686, 688, 690

[56] References Cited

U.S. PATENT DOCUMENTS

| | | | |
|---|---|---|---|
| 2,562,575 | 7/1951 | Raesler | 324/671 |
| 3,633,740 | 1/1972 | Westmoreland | 209/572 |
| 3,679,972 | 7/1972 | Michelson | 324/671 |
| 3,990,005 | 11/1976 | Abbe et al. | 324/679 X |
| 4,223,751 | 9/1980 | Ayers et al. | 209/571 X |
| 4,402,412 | 9/1983 | Wood | 209/571 X |
| 4,569,445 | 2/1986 | Kovats et al. | 209/539 |
| 4,860,229 | 8/1989 | Abbe et al. | 324/671 X |
| 4,922,181 | 5/1990 | Pullan | 324/690 X |

*Primary Examiner*—Michael S. Huppert
*Assistant Examiner*—Edward M. Wacyra
*Attorney, Agent, or Firm*—Palmatier & Sjoquist

[57] ABSTRACT

A device for sorting tablets by capacitive measurement, including a disk rotating between capacitor plates, a tablet fielding device for sequentially metering a series of tablets onto the disk, an arcuate guide assembly for guiding the tablets along a guide path as the disk rotates, and a deflector assembly for deflecting the tablets along one of the possible paths, as a consequence of the capacitance measurement.

19 Claims, 4 Drawing Sheets

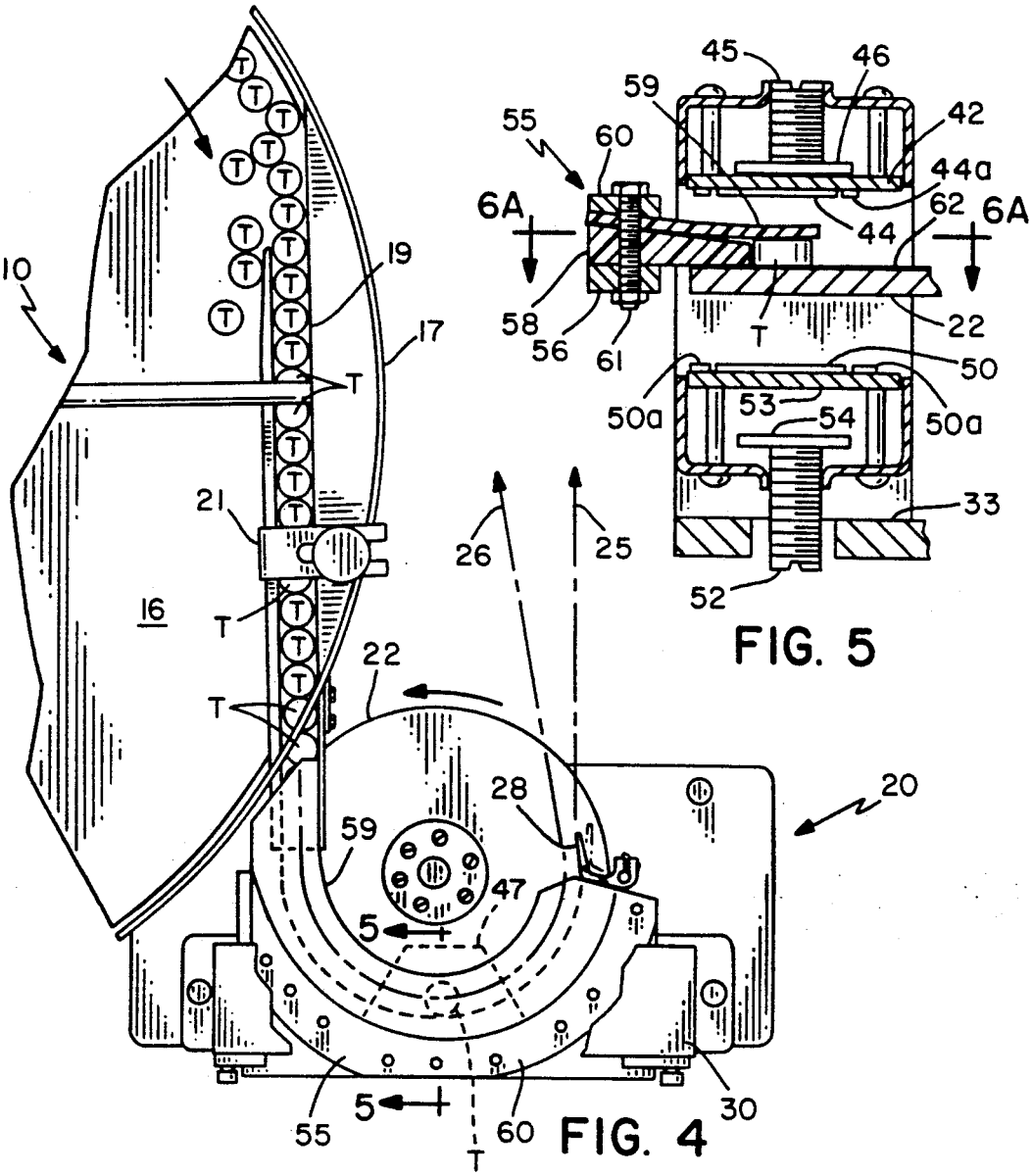
FIG. 5
FIG. 4
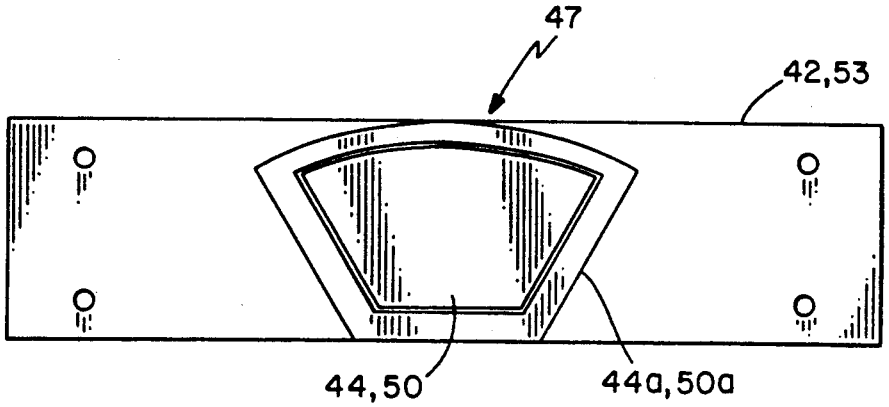
FIG. 6B

HIGH-SPEED TABLET SORTING MACHINE

BACKGROUND OF THE INVENTION

The present invention relates to machines for weighing and classifying tablets, particularly at a high rate of speed. The invention utilizes the basic principle of capacitance, wherein the weight of a tablet can be determined within precise limits by passing the tablet through a capacitance sensor, and measuring the change in capacitance which results from the presence of the tablet in the sensor.

In the prior art, high-speed machines have been developed for classifying pharmaceutical capsules, as in U.S. Pat. No. 4,223,751, issued Sep. 23, 1980, and owned by the assignee of the present invention. A further and related patent is found in U.S. Pat. No. 4,402,412, issued Sep. 6, 1983. In both of the foregoing patents the weight of a capsule in a stream of capsules is determined by passing the moving capsule through a fixed capacitive sensor arranged in tubular form, wherein the resultant change in capacitance provides a measure of capsule weight. A deflector mechanism is provided downstream in the path of capsule travel, and the capsules which are measured outside of certain weight parameters are deflected from the path of travel into a reject bin. Capsules which measure within the desired weight range are permitted to continue in the path of travel to be received in a second bin.

The basic capacitance principles of the foregoing patents are utilized in the present invention albeit in a different constructional form, in order to accommodate the different problems which arise in connection with measuring the weight of tablets. Whereas a capsule is constructed of uniform form, by placing a measured quantity of powder inside a preformed housing, a tablet tends to be of nonuniform shape and of varying size. Capsules are symmetrical about a longitudinal axis and are therefore amenable to propagation through a tubular passage, whereas tablets are of somewhat nonuniform disk shapes, having a predetermined diameter and varying thickness dimensions. When tablets are propagated through a tube they tend to tumble and jam up in the flow path, thereby rendering devices of the type disclosed in the prior art patents useless for weighing and classifying tablets.

In attempting to apply the machines of the type disclosed in the foregoing patents to the problem of weighing tablets, it became apparent that an entirely different approach to the design of the transport and sensing mechanism would have to be utilized, and the present invention resulted from the study of applying capacitance measuring techniques to a high-speed moving stream of tablets.

SUMMARY OF THE INVENTION

The present invention comprises a disk which rotates at a relatively high rate of speed between a pair of capacitance sensors, wherein the sensors are spaced at approximately equal distances from the disk and encompass a segment of disk rotation. A feed mechanism is coupled to the disk to provide a serial stream of tablets onto the rotating disk surface, so that respective tablets may be oriented to a common position and spaced apart an arcuate distance about the disk. The tablets are carried in a rotational path on the surface of the disk, and after passing through the sensor the tablets are gated off the disk into either of two travel paths. The gating mechanism is operated in conjunction with the sensor, to deflect the tablets in either of two directions, depending upon the sensed capacitance parameters.

It is the principal object of the present invention to provide a high-speed machine for weighing and classifying tablets by capacitance measurement of tablets in a moving stream and selective deflection of certain tablets from the moving stream.

It is another object of the present invention to provide a high-speed weighing and classifying machine in which a continuous and serial stream of tablets may be measured without interruption, and deflected into various classifying bins, depending upon the parameters measured.

It is another and further object of the present invention to provide a high-speed weighing and classifying machine which can make repeatable and accurate measurements of the weight of individual tablets in a continuous and serial stream of tablets.

The foregoing and other objects of the invention will become apparent from the following specification and claims, and with reference to the appended drawings.

BRIEF DESCRIPTION OF THE DRAWINGS

FIG. 4 shows a top view of a portion of the machine;

FIG. 5 shows a cross-section view taken along the lines 5—5 of FIG. 4;

FIG. 6B shows a printed circuit board with capacitance sensor; and

DESCRIPTION OF THE PREFERRED EMBODIMENT

Figures 1, 6A:
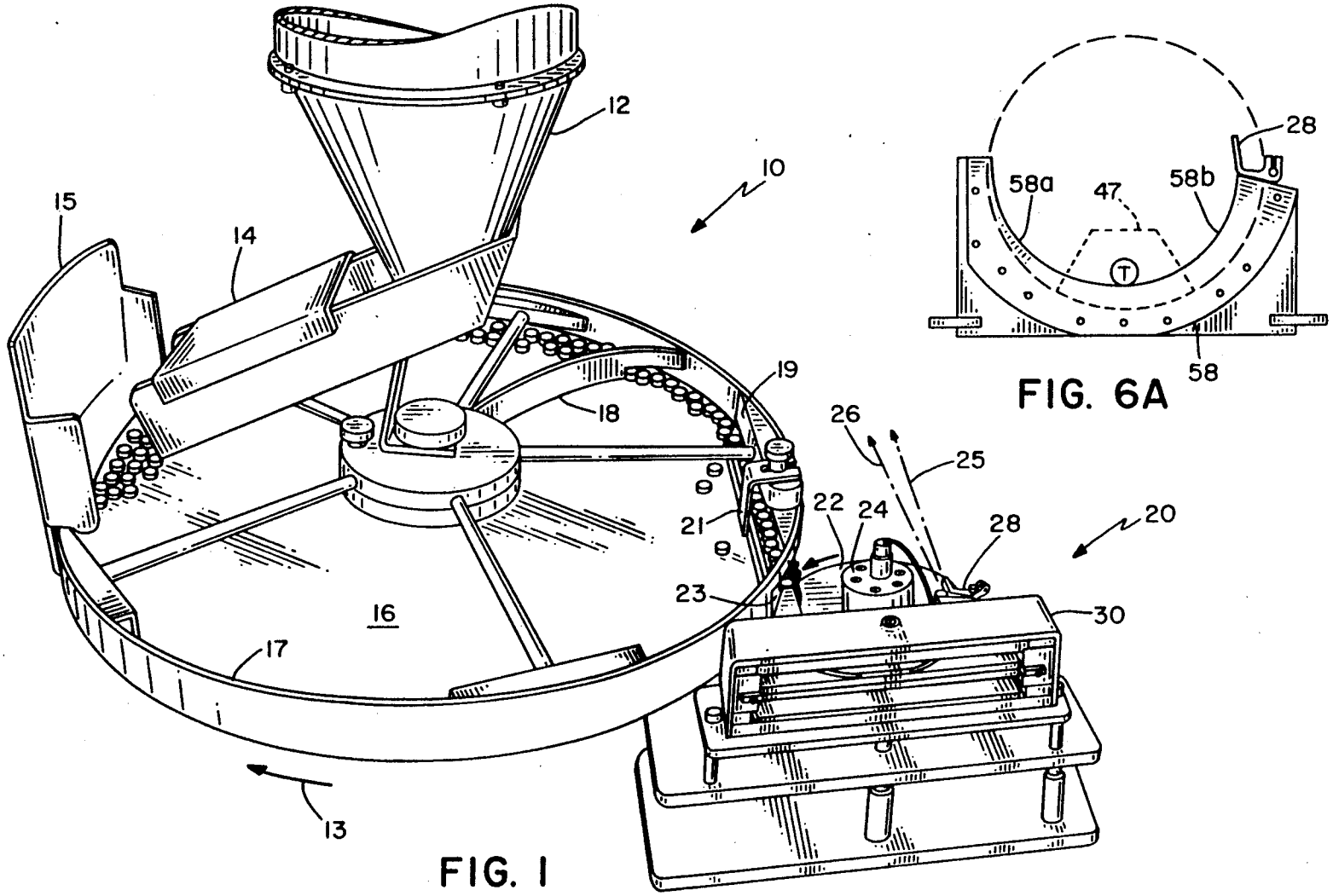
FIG. 1 shows an isometric view of the machine.
FIG. 6A shows a cross-section view taken along the lines 6A—6A of FIG. 5.

FIG. 1 shows the invention in isometric view. A feeder system 10 comprises a hopper 12, a chute 14 and a rotatable turntable 16, all of which are generally known in the prior art. Turntable 16 is generally rotatable at a rate of from six to ten revolutions per minute, depending upon tablet size, and the turntable typically has a diameter of 20 inches. A deflector 15 is positioned at the end of chute 14, to deflect tablets which slide downwardly through chute 14 onto the surface of turntable 16. Turntable 16 is encircled by a fixed circumferential raised lip 17 to confine the tablets on the turntable. A curved deflector 18 is positioned close to the top surface of turntable 16, deflector 18 having an outer opening to permit tablets to pass therethrough. Curved deflector 18 forces tablets moving about turntable 16 to move to the outer circumference of turntable 16. A guide 19 is tangentially arranged relative to the outer circumference of turntable 16, and a movable gate 21 is positioned to permit only an aligned stream of tablets to flow along the tangential path adjacent guide 19.

As tablets are loaded into hopper 12, they pass through an opening in the bottom of hopper 12 into chute 14, and downwardly to the top surface of turntable 16. Tablets are carried by turntable 16 about a rotational direction as indicated by arrow 13. As the tablets pass through curve deflector 18 they are guided outwardly to the outer circumference of turntable 16, and more or less into a sequential stream of tablets. This sequential stream is further controlled by guide 19 and movable gate 21, to confine the tablet stream into a straight, sequential stream of tablets. This sequential stream of tablets is conveyed through an outer opening 23 in raised lip 17, to be received by sensor system 20.

Sensor system 20 comprises a rotatable metal disk 22 which is typically about 5-¼ inches in diameter. Disk 22 is rotated by a drive motor 24 at a controlled rotational rate of about 600 revolutions per minute. The tablets are guided about a rotational path along disk 22, and are ejected from disk 22 along either of two paths 25, 26 as illustrated by the broken lines in FIG. 1. A movable deflector 28 is controllable to control the deflection of the tablets along either path 25 or 26.

A sensor housing 30 is positioned about an arcuate portion of disk 22 as will be described more fully hereinafter. Sensor system 20 may be adjusted vertically and horizontally to permit disk 22 to rotate freely at the same plane as turntable 16, and adjacent to turntable 16.

Figure 2:
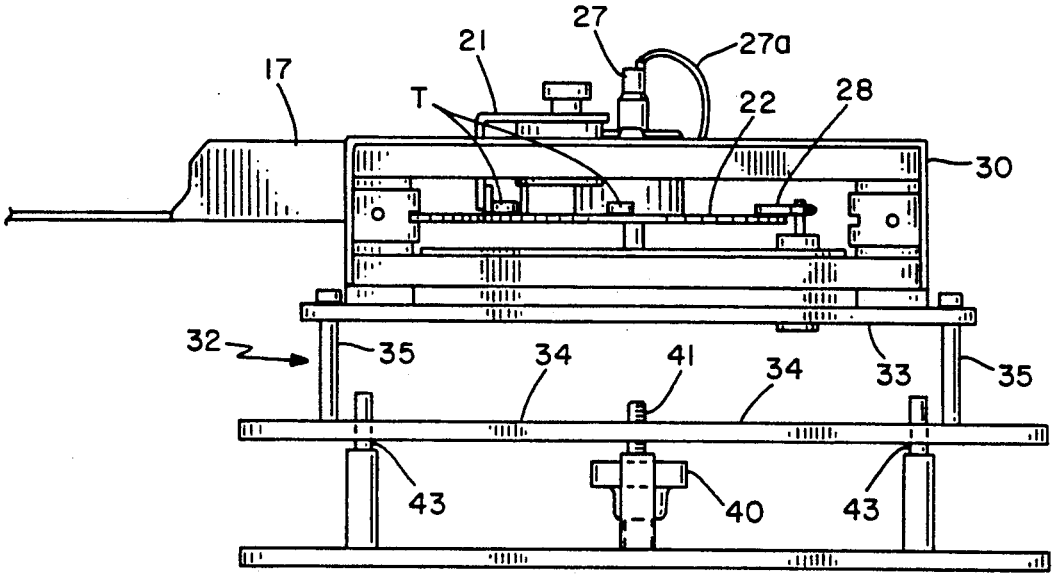
FIG. 2 shows a front elevation view of a portion of the machine.

FIG. 2 shows a front elevation view of a portion of the invention, particularly including sensor housing 30. The sensor which is confined within sensor housing 30 has been removed for clarity, in order to show the relationship between sensor housing 30 and disk 22. Disk 22 rotates in a plane approximately centrally located relative to sensor housing 30. Sensor housing 30 is attached to a subframe assembly 32, which is comprised of an upper plate 33 and a lower plate 34 held together by fixed spacers 35. Subframe assembly 32 is vertically movable by turning knob 40, which is affixed to a threaded shaft 41. Shaft 41 is threaded through lower plate 34, so that rotation of knob 40 causes lower plate 34 (and therefore subframe assembly 32) to move upwardly or downwardly. The vertical movement of subframe assembly 32 is guided by vertical posts 43 which slidably fit through openings in lower plate 34. The range of vertical movement of subframe assembly 32 is approximately 1 inch, and this range of movement permits an adjustment of sensor system 20, including disk 22, relative to feeder system 10, particularly turntable 16. FIG. 2 also shows two tablets "T" resting on disk 22 in representative positions.

Figure 3:
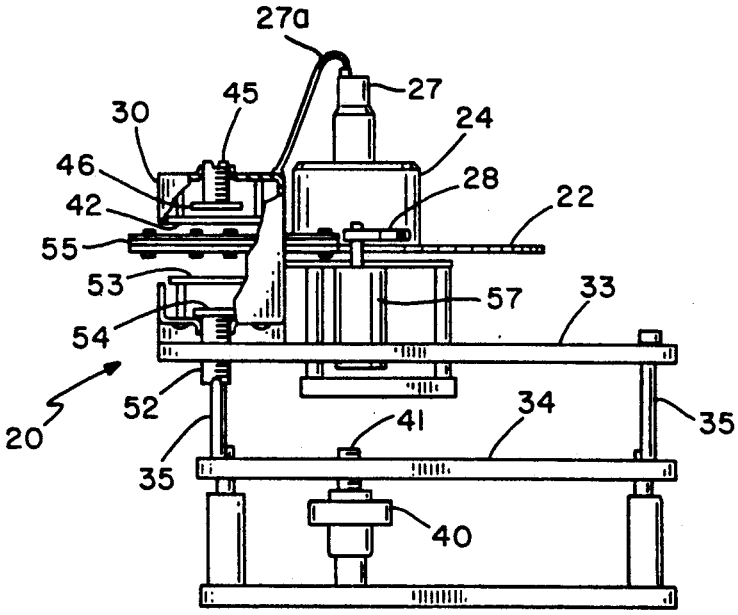
FIG. 3 shows a side elevation view of the machine portion.

FIG. 3 shows a side elevation view of sensor system 20, with sensor housing 30 shown in partial breakaway. Sensor housing 30 contains an upper circuit board 42 which is fixedly supported within housing 30, and a lower circuit board 53 which is also fixedly supported within housing 30. An upper conductive plate 46 is affixed to screw 45, and a lower conductive plate 54 is affixed to screw 52. Conductive plates 46, 54 are respectively threadably adjustable in a vertical direction relative to circuit boards 42, 53 to provide initial capacitance sensor circuit adjustments as will hereinafter be described.

A rotary contact device 27 is mounted on drive motor 24, specifically making electrical contact with the rotary shaft of drive motor 24. Rotary contact 27 is preferably a sealed mercury rotary contact device which is commercially available. One such device is sold under the product designation "Rotocon-MI", by Meridian Laboratory of Middleton, Wisconsin. Rotary contact 27 is connected via conductor **27*a* to a suitable electrical ground, which is associated with the electrical ground on circuit boards 42 and 53**.

A tablet guide assembly 55 is affixed adjacent disk 22 over an arcuate portion of disk 22, within sensor housing 30. Tablet guide assembly 55 will be described in more detail with reference to the following figures.

FIG. 4 shows a top view of a portion of feeder system 10 and sensor system 20. Sensor housing 30 is shown in partial breakaway, to illustrate some of the components within sensor housing 30. The path of travel of a plurality of tablets "T" is also illustrated in broken line form, and a representative number of tablets "T" are shown on the figure. As the tablets "T" pass through the gate 21 on turntable 16 and exit through the opening in lip 17, the tablets are conveyed onto disk 22. The tablets are carried around disk 22 in an arcuate path, guided by guide assembly 55, and exit from disk 22 via path 25 or 26, depending upon the relative position of deflector 28. FIG. 4 shows deflector 28 in solid outline positioned to deflect tablets along path 26, and shows deflector 28 in dotted outline positioned to deflect tablets along path 25. As the tablets "T" pass through the arcuate path on disk 22, each tablet passes between the capacitive plates of sensor 47; FIG. 4 shows a tablet "T" centrally positioned between the capacitive plates of sensor 47.

The capacitance plates are constructed in the form shown on FIG. 6B, by forming them on the surface of a printed circuit board. Each capacitance plate 44, 50 is bordered by a guard ring **44*a*, 50*a*** also formed on the same printed circuit board, with a small gap of nonconductive material between the two surfaces. The guard rings serve to control capacitive fringe effects, and therefore to provide a more reliable capacitance measurement in operation.

Figure 7:
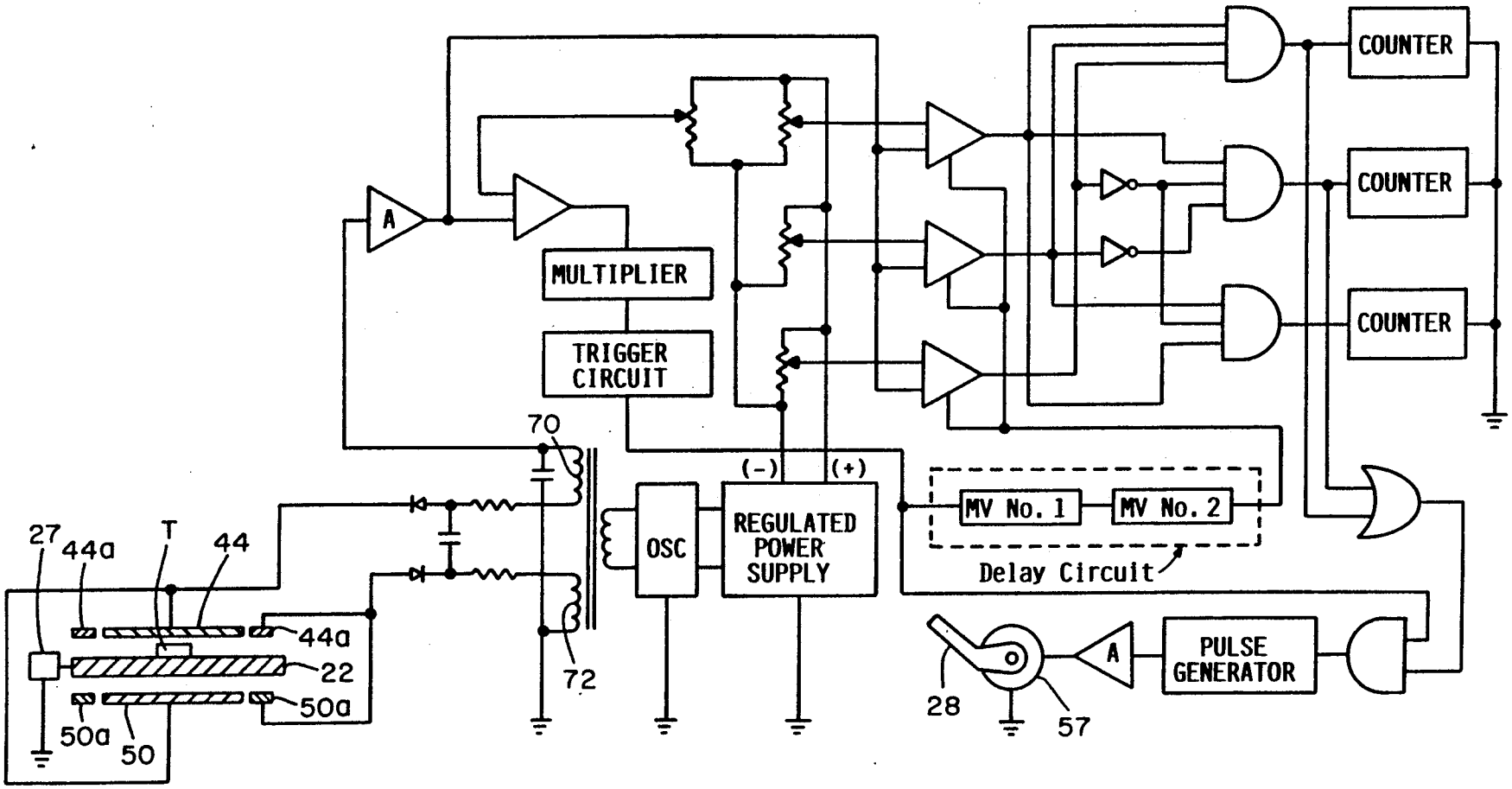
FIG. 7 shows a combined schematic and block diagram illustrating the electrical components used with the invention.

FIG. 5 shows a cross-sectional view taken along the lines 5—5 of FIG. 4. Disk 22 is centrally located between an upper capacitive plate 44 and a lower capacitive plate 50. Capacitive plate 44 and guard ring **44*a* are formed on the surface of printed circuit board 42, and are electrically connected to sensing circuits (FIG. 7). Similarly, capacitance plate 50 and guard ring 50*a* are formed on the surface of printed circuit board 53, and are electrically connected to sensor circuits (FIG. 7**).

A tablet "T" is guided between the capacitive plates 44, 50 by the rotational motion of disk 22 and tablet guide assembly 55. Tablet guide assembly 55 includes a lower arcuate mounting plate 56, a guide member 58, a resilient clamping sheet 59, and a mounting plate 60. All of the components of tablet guide assembly 55 are affixed together by a plurality of screws 61. The top surface of guide member 58 is inclined or beveled, which provides a slope of approximately 3°, for deflecting the clamping sheet 59 downwardly toward disk 22. This provides a slight inward bias of clamping sheet 59, to provide a downward force against tablets "T" and thereby hold the tablets against the surface of disk 22 and guide member 58. The surface of disk 22 is itself coated with a thin layer 62 of rubberized material to provide a significant coefficient of friction, to prevent slippage of tablets "T" as they are conveyed about the arcuate path of sensor system 20. The undersurface of clamping sheet 59 is preferably coated with a high-slip material such as a material sold under the commercial name "Teflon". The object is to provide a tablet gripping surface on disk 22, and a tablet sliding surface on the underside of clamping sheet 59.

FIG. 6A shows a cross-section view taken along the lines 6A—6A of FIG. 5, to illustrate in particular the shape of guide member 58. Guide member 58 comprises an arcuate plastic member, preferably constructed of a plastic material known commercially as "Delrin," having two curvature sections. A first curvature section 58a is in the form of an ellipse, beginning at one end of guide member 58 and extending approximately to the center point of the guide member. The second curvature 58b is circular, beginning at the other end of guide member 58 and extending proximately to the center of the guide member. The two curves are smoothly merged at the center point, which is also the proximate center of the capacitive plates 44, 50. As a tablet "T" is carried along about disk 22, centrifugal force will cause the tablet to be conveyed along the guide member 58 curvature portions. The purpose of the ellipse curve portion 58a is to ensure that the tablet "T" is firmly held against a guide edge during its traverse across the sensor 47. After the tablet passes through the sensor profile it is conveyed along the circular curve 58b until it reaches the end of guide member 58. At that point, the tablet follows a direction determined by deflector 28, to be deflected along either path 25 or 26 as described hereinbefore.

FIG. 7 illustrates a logic and block diagram showing a form of circuitry which may be utilized with the present invention. Reference should be made to U.S. Pat. No. 4,223,751 for the full and complete description of the operation of this circuit. Although certain details of the operation of the circuit may be modified to accommodate the present invention. Such modifications as may be required to the circuit are well within the skill of the art, taking into account the speed of rotation of the disk and the relative movement of tablets as they are fed into the disk. For example, the arcuate dimension of the capacitive plates 44, 50 is about 60° (see FIG. 6B), and the speed of disk 22 is controlled at about 600 revolutions per minute. The time required for a tablet to progress from the capacitive sensor to the deflector 28 can be readily calculated, and the parameters of the circuit of FIG. 7 are adjusted so as to synchronize the action of deflector 28 with the arrival of a tablet after if has been sensed by the capacitance sensor 47. Tablets are fed onto disk 22 at a serial sequential rate, and the angular separation between any two tablets on disk 22 ranges from 120° and 180°; therefore, the time between consecutive capacitance measurements is about 30–60 milliseconds. The response time required for activating deflector member 28 approximately 7 milliseconds.

Disk 22 is electrically connected to ground potential as illustrated in FIG. 7, via rotary contact 27. Capacitance plate 44 and capacitance plate 50 are electrically connected together, and to one side of a transformer winding 70. Guard ring 44a and guard ring 50a are electrically connected together, and to one side of transformer winding 72. In the event disk 22 undergoes any wobble during its rotation, it will tend to increase the capacitance relative to one capacitance plate while simultaneously decreasing capacitance relative to the other capacitance plate. Therefore, the sum of the capacitance will remain unaffected by any disk wobble. When a tablet passes beneath capacitance plate 44 it results in a net change in capacitance of the circuit, and this results in a capacitance drive signal being conveyed to transformer 70. The circuitry of FIG. 7 will then operate on this drive signal to provide an electrical pulse to solenoid 57, thereby causing movement of deflector 28. Deflector 28 controls the exit guide path of the tablet as it is ejected from the disk.

The initial setup and calibration of the sensor system 20 can best be understood with reference to FIG. 5. The objective of the initial setup procedure is to equalized, to the extent measurable, the capacitance between disk 22 and capacitor plate 44 versus the capacitance between disk 22 and capacitor plate 50. It has previously been stated that disk wobble during operation will affect these capacitances in inverse directions, thereby creating a net capacitance change of zero. Because of nonlinearities in the capacitance curve, this is strictly true only when the two capacitances are equal, and if the capacitances are unequal the signal received by the electronic detector circuit will appear as electrical noise. Therefore, the initialization procedure is utilized to equalize the capacitance values by reducing the measured noise received by the sensor electronics; this is accomplished by first centering disk 22 between plates 44 and 50, and then selectively varying the distances between plate 46 and capacitor plate 44, and plate 54 and capacitor plate 50. Screw 45 is rotated to place plate 46 at a predetermined distance from plate 44, while monitoring the noise signal value, to position the plate 46 where the noise signal is at its lowest value. Next, screw 52 is turned to position plate 54 at a distance from capacitor plate 50 which further results in maximum reduction of measured noise signal value. When screws 45 and 52 are positioned in this manner, for minimum signal noise value, it may be presumed that the capacitances are set to equal values.

In the preferred embodiment, a commercially available disk drive system was selected, from disk drives which are commonly utilized for magnetic recording systems. The disk 22 is a conventional commercially available metal magnetic recording disk, without the usual magnetic coating material being applied. A thin layer of rubberized material is applied to the top surface of the disk to provide a significant coefficient of friction, and the motor speed control circuit (not shown) is set to drive the disk at a constant rotational speed. This embodiment produces a disk wobble of about 100 micro inches, which causes a capacitance change between the disk and either of the capacitor plates of $140 \times 10^{-6}$ picofarads (pf). When the two capacitances are equal initially, a variation of $140 \times 10^{-6}$ picofarads in one capacitance causes an equal and opposite variation in the other capacitance.

As an example of the system sensitivity, a commercially available pharmaceutical tablet weighing 665 milligrams was measured to create a capacitance change between disk 22 and capacitance plate 44 of $14.99 \times 10^{-3}$ picofarads (pf), which calculates to a variation of $22.54 \times 10^{-6}$ picofarads per milligram of tablet weight. The desired system sensitivity is to detect as little as a one milligram change in tablet weight, and therefore it is desirable that system sensitivity be on the order of $20 \times 10^{-6}$ picofarads; the sensitivity objective was reached in the preferred embodiment of the present invention.

In operation, the tablets which are fed in bulk into hopper 12 are conveyed onto turntable 16, and are randomly distributed thereabout. As the turntable 16 rotates the tablets are forced outwardly along lip 17 and are conveyed into gate 21. Gate 21 arranges the tablets in a serial stream where they are fed through opening 23 onto disk 22. Because disk 22 rotates at an approximately 100 times faster rate than turntable 16, as each tablet drops onto the surface of disk 22 it is rapidly separated from its next trailing tablet and conveyed beneath the capacitance sensor. The capacitance measurement is made electronically and transformed by the circuit of FIG. 7 to generate an actuation signal to deflector member 28. Deflector 28 positions itself to guide the tablet along either of the guide paths 25, 26 as the tablet is ejected from the disk. Guide paths 25, 26 are respectively arranged to terminate in a collection bin, where the tablets may be collected for further processing. One of the collection bins may be a "reject" bin, which bin contains the tablets which fall outside of predetermined capacitance parameters, and these tablets may be discarded.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for sorting tablets by capacitance measurements, comprising:

a) a rotatable disk having means for rotating at a first controllable rate in a substantially horizontal plane;

b) a first conductive plate positioned a predetermined distance above said disk, and a second conductive plate positioned a predetermined distance below said disk, said first and second plates being in substantial vertical alignment;

c) a guide assembly placed proximate the periphery of said disk, said guide assembly having an arcuate edge adjacent said disk, said arcuate edge forming a guide path at least partially about said disk and passing between said disk and said first conductive plate;

d) a movable lever positioned adjacent an end of said guide path, said lever forming an extension of said guide path, and said lever being electrically movable into at least two guide path extension positions;

e) means for sequentially conveying tablets onto said disk;

f) means for electrically coupling said first and second conductive plates, and said disk, into a signal detection circuit whereby the output signal from said signal detection circuit is representative of the capacitance sum between said first plate and said second plate, relative to said disk whereby a capacitance value between said first plate relative to said disk characterizes the tablets; and g) means for transmitting the output signal from said signal detection circuit to said electrically movable lever, whereby said lever is actuated to one of said at least two guide path extension positions.

2. The apparatus of claim 1, wherein said guide assembly further comprises a resilient cover member overhanging said arcuate edge.

3. The apparatus of claim 2, wherein said means for sequentially conveying further comprises a rotatable turntable aligned substantially tangentially with said rotatable disk.

4. The apparatus of claim 3, wherein said rotatable turntable further comprises means for rotating said turntable at substantially one-one hundredth the rotation rate of said disk.

5. The apparatus of claim 1, wherein said first and second conductive plates are each shaped with an arcuate outer edge.

6. The apparatus of claim 5, wherein said first and second conductive plates are respectively shaped to form an arcuate segment of approximately 60°.

7. The apparatus of claim 6, further comprising means for vertically adjusting said first and second conductive plates.

8. The apparatus of claim 7, further comprising means for vertically adjusting said disk rotational plane.

9. The apparatus of claim 8, further comprising means for adjusting the vertical position of said first conductive plate independently of said second conductive plate.

10. The apparatus of claim 1, wherein said guide assembly further comprises a plastic guide member having said arcuate edge, and a resilient plastic sheet clamped adjacent said guide member, said plastic sheet being biased toward said disk.

11. The apparatus of claim 10, wherein said rotatable disk further comprises an upper surface coating having a substantial coefficient of friction.

12. The apparatus of claim 11, wherein said resilient plastic sheet further comprises polystyrene plastic.

13. The apparatus of claim 12, wherein said electrically movable lever further comprises a solenoid actuator having a shaft rotatable into at least two actuable positions, and a deflector bar affixed to said shaft.

14. The apparatus of claim 13, wherein said resilient plastic sheet further comprises a layer of Teflon® facing toward said disk.

15. An apparatus for measuring the capacitance of tablets, comprising:

a) a pair of spaced-apart capacitor plates electrically coupled to a capacitance detection circuit;

b) a rotatable conductive disk positioned between said capacitor plates, said disk being at electrical ground potential relative to said capacitance detection circuit;

c) an arcuate guide assembly positioned adjacent said disk, said guide assembly forming an arcuate guide path about at least a portion of said disk and between said capacitor plates; and d) means for sequentially feeding a plurality of tablets onto said rotatable disk, whereby said tablets are conveyed along said arcuate guide path between said capacitor plates for effecting capacitance measurement thereof by said capacitance detection circuit.

16. The apparatus of claim 15, further comprising an electrically-operated actuator positioned adjacent an end of said arcuate guide path, and means for coupling said capacitance detection circuit to said electrically-operated actuator.

17. The apparatus of claim 16, wherein said guide assembly further comprises a first guide plate adjacent said disk and having an inwardly facing arcuate edge, and a resilient clamping sheet affixed above said first guide plate, said clamping sheet being biased toward said disk.

18. The apparatus of claim 17, wherein said first guide plate arcuate edge further comprises a first portion formed along an elliptical curve, and a second portion formed along a circular curve.

19. The apparatus of claim 18, wherein said clamping sheet further comprises polystyrene plastic having a Teflon® surface facing toward said disk.

* * * * *